US005771433A

United States Patent [19]

Kimijima

[11] Patent Number: 5,771,433

[45] Date of Patent: Jun. 23, 1998

[54] METHOD AND SYSTEMS FOR HOLDING IMAGE CARRYING MEDIA OF VARIOUS SIZES

[75] Inventor: Masashi Kimijima, Ebina, Japan

[73] Assignee: Ricoh Company, Ltd., Tokyo, Japan

[21] Appl. No.: 638,768

[22] Filed: Apr. 29, 1996

[30] Foreign Application Priority Data

Apr. 28, 1995 [JP] Japan ..... 7-127584
Feb. 2, 1996 [JP] Japan ..... 8-039098

[51] Int. Cl.[6] ..... G03G 15/00

[52] U.S. Cl. ..... 399/369; 399/376

[58] Field of Search ..... 235/98 R, 98 B; 355/23; 399/16–19, 21–25, 43, 138, 204, 367, 369, 370, 372, 376–377, 379, 389; 270/3.02, 3.06, 3.09, 3.12, 9.06

[56] References Cited

U.S. PATENT DOCUMENTS

| | | | |
|---|---|---|---|
| 4,961,091 | 10/1990 | Kasuya et al. | 335/321 |
| 5,034,780 | 7/1991 | Kotabe et al. | 335/316 |
| 5,075,783 | 12/1991 | Yoshida et al. | 358/439 |
| 5,096,180 | 3/1992 | Nagaoka et al. | 271/110 |
| 5,281,991 | 1/1994 | Oonishi et al. | 355/29 |
| 5,367,362 | 11/1994 | Forest | 355/208 |
| 5,383,004 | 1/1995 | Miller | 355/206 |
| 5,484,140 | 1/1996 | Hirose et al. | 271/175 |
| 5,506,661 | 4/1996 | Hanzawa | 355/209 |
| 5,590,871 | 1/1997 | Okabe et al. | 270/58.27 |

FOREIGN PATENT DOCUMENTS

| | | |
|---|---|---|
| 63-2862 | 1/1988 | Japan . |
| 63-6118 | 2/1988 | Japan . |
| 63-218463 | 9/1988 | Japan . |
| 7-330201 | 12/1995 | Japan . |

*Primary Examiner*—Matthew V. Nguyen
*Attorney, Agent, or Firm*—Woodcock Washburn Kurtz Mackiewicz & Norris LLP

[57] ABSTRACT

The current invention is directed to systems and methods determining an overflow situation for a output catch tray device for holding a predetermined capacity of a image-carrying medium in image-duplicating machines such as photocopiers, facsimile machines and printers. The overflow condition is monitored by keeping track of a number of sheets of an image-carrying medium in a predetermined size and is independent from an inflexible mechanical device such as a torque limiter on a holding roller. In addition, the overflow beyond the predetermined capacity is flexibly adjusted based upon the conversion data.

54 Claims, 10 Drawing Sheets

| THE PAPER LENGTH | COUNT |
|---|---|
| LESS THAN 364mm(B4) | 1 |
| 364mm ~ 500mm | 1.5 |
| 500mm ~ 800mm | 2 |
| ⋮ | ⋮ |

METHOD AND SYSTEMS FOR HOLDING IMAGE CARRYING MEDIA OF VARIOUS SIZES

FIELD OF THE INVENTION

The current invention is generally related to an output image-carrying medium holder for an image duplicating devices such as printers, photocopiers, facsimiles and scanners, and more particularly related to an output holder of a type that holds the image-carrying medium such as paper by urging a portion of the output.

BACKGROUND OF THE INVENTION

In order to maintain output image-carrying media such as paper in a desired stack in image duplicating devices, various types of trays have been implemented. Among these various types of output catch trays, four most prevalent categories include horizontal type trays, upper surface type trays, drop type trays and catch type trays.

Briefly, the horizontal and upper surface type trays are usually located substantially in parallel to an output outlet, and an image-carrying medium slides on the tray. The upper surface type trays are generally located adjacent to a platen glass where an original is placed. The horizontal type trays are not necessarily located near the top surface. Using either type of the trays, image-carrying outputs are stacked, because the image-carrying medium slides over an already outputted image-carrying medium, the integrity of the stack is not necessarily maintained. For example, a pile may not be neatly stacked due to friction or different paper sizes.

The drop type trays are generally located below an output outlet so that an image-carrying medium is dropped onto the tray after it departs the output outlet. Although drop type trays do not generally suffer the problems due to friction between image-carrying media, as the image-carrying medium is dropped on to the tray, the image-carrying medium may not be neatly piled or a sequence of the outputs may not be correctly maintained. In a worse situation, an image-carrying medium fails to land on the tray and ends upon the floor.

The catch type trays generally have at least advantages over the above described types of trays. As will be fully described below, the catch type trays are generally smaller and occupy less space than other type. In addition, the catch type trays maintain the correct sequence of the outputs. The catch type trays featuring these two advantages have been disclosed in some Japanese patent publications such as Utility Model Patent Publication 63-6118, Patent Publication 63-2862, and Japanese Patent 63-218463. In addition, Patent Application 6-128434 disclosed an improved catch tray for accommodating various sizes of the image-carrying medium.

To appreciate the above mentioned advantages of the catch type trays, the embodiments disclosed in Japanese Patent Application 6-128434 are illustrated in FIGS. 1 and 2 and summarized in a block diagram in FIG. 3. Referring to FIG. 1, one example of a catch tray unit is located adjacent to an output outlet 12 of an image duplicating device such as a printer, a photocopier, a facsimile machine and so on. This exemplary catch type tray generally includes a pair of guide path plates 13 and 14 which provide a path for an output image-carrying medium 4 to travel towards a holding unit or holder 7. The pair of the guide path plates 13 and 14 are bent in a U-shape, and one end of the plates 13 and 14 are near the output outlet 12 while the other end of the plates lead to the output holder 7. The outer guide plate 13 is shorter than the inner guide plate 14, and a portion of the inner guide plate 14 faces a stacking plate 24 of the output holder 7 to provide the output path. The image-carrying medium 4 can travel between the guide plates 13 and 14 either in the length wise direction or the width wise direction of the image-carrying medium 4.

In order for the image-carrying medium 4 to travel from the output outlet 12 towards the output holder 7, a number of rollers located along the path guide contacts and propels the image carrying medium 4 as they rotate in a coordinated manner. As the image-carrying medium 4 is outputted through the output outlet 12, a sensor 3 detects the output and sends a detection signal to a paper output unit which is not shown in FIG. 1. The paper output unit initiates the rotation of a pair of opposing transfer rollers 16 and 18, which are located along the U-shaped guide path plates 13 and 14. As the image-carrying medium 4 reaches the transfer rollers 16 and 18 in the paper path, the opposing rollers 16 and 18 engage the image-carrying medium 4 and propels it further down the paper path towards the holder 7 as they rotate in opposite directions at a predetermined speed. The image carrying medium 4 then reaches a hold roller 19 which extends through a window on the inner guide plate 14 and is located over a stacking plate 24. The hold roller 19 further transports the image carrying medium 4 towards a terminal portion 15 of the guide plates. As a leading edge of the image-carrying medium 4 reaches the terminal portion 15 of the guide path plate 14, the image-carrying medium 4 is held between the hold roller 19 and the stacking plate 24 or between the inner guide path plate 10 and the stacking plate 24. As a result of the above described travel in the U-shape path, the image carrying medium 4 is turned front and back. Because of this function, the above catch tray unit is also described as a turn-over type catch tray.

The output holder 7 generally includes a stacking plate 24, at least a portion of which is urged towards a holding portion of the inner guide path plate 10. Springs 26 placed between the stacking plate 24 and a shelf plate 27 push the stacking plate towards the inner guide plate 10 so that at least a leading portion of the image-carrying medium 4 is pinched between the two structures. As an additional sheet of the image-carrying medium 4 is held between the stacking plate 24 and the guide plate 10, the springs 26 are further compressed to yield additional room between the two plates.

Now referring to FIG. 2, one example of the catch type tray unit includes an operable portion 23 of the outer path guide plate 13. The operable portion 23 has a side plate 30 attached to each end for pivoting on a shaft 31. After a leading edge portion of the image-carrying medium 4 reaches the stacking position between the guide plate 10 and the stacking plate 24, the operable portion 23 is opened by rotating the shaft 31 in a clockwise direction. As a result, a trailing portion of the image-carrying medium 4 at the above described stacked position is exposed through the open space created by the movable portion 23. Further rotation of the transfer rollers 16 and 18 pushes the trailing portion of the image-carrying medium 4A out of the boundary of the outer path guide 13 as shown in FIG. 2. When the trailing edge of the image-carrying medium 4A clears the transfer rollers 16 and 18, a trailing portion of the image-carrying medium 4B is bent along a distal edge of the stacking plate 24 by its weight. In other words, a substantial trailing portion of the image-carrying medium at the finally stacked position hangs downwardly. Upon completing the above described transfer/stacking operation of the image-carrying medium, the operable portion 23 of the outer path guide plate 13 returns to its closed position to provide an initial continuous path leading towards the holding unit 7.

Now referring to FIG. 3, the operation of the above described catch tray unit is described in a block diagram. A paper output sensor 3 detects an image-carrying medium and sends an activation signal to a control unit 5. In response to the activation signal, the control unit 5 activates a motor 29 and selectively turns a clutch 33 at a predetermined timing so that a transfer roller 16, an opposing roller 18, a hold roller as well as an operable guide portion 23 are respectively rotated at appropriate times. The clutch selectively engages one or more of the above parts for transferring the rotational force generated by the motor.

In summary, the above described exemplary catch type tray unit provides at least two significant advantages. Since the image-carrying medium does not take up its full length, a total amount of space occupied by the catch tray unit is substantially less than other tray units that require space equivalent to the full length of the image-carrying medium. In addition, the holding unit stacks and holds outputted sheets of the image-carrying medium in a correct sequence.

To accomplish the desired stacking of the image-carrying medium, referring back to FIG. 2, the hold roller 19 pushes the leading portion of an incoming image-carrying medium over the surface of the already stacked image-carrying medium. However, this stacking mechanism over-stacks the image-carrying medium beyond a capacity of the holding unit 7. To prevent over-stacking of the image-carrying medium in the stacking unit 7, the hold roller 19 is equipped with a torque limiter. As a pile of the stacked image-carrying medium grows, the stacking plate 24 further compresses the springs 26, and the urging pressure against the hold roller 19 is increased. When the urging pressure is beyond the predetermined torque of the hold roller 19, the hold roller fails to rotate due to the torque limiter, and the incoming image-carrying medium is prevented from being stacked beyond the predetermined capacity of the holding unit 7.

The above described prevention mechanism is not generally reliable. As the hold roller torque approaches the predetermined limit, the image-carrying medium is often jammed in the process of the final transfer for stacking in the pile. Furthermore, the above described prevention mechanism is not capable of adjusting for various sizes and quality of the image-carrying medium. Since the holding unit has a predetermined capacity for the total weight of the stacked image-carrying medium and various sizes of the image-carrying medium each weigh differently, the above described prevention mechanism fails to provide adequate adjustments for determining a limit.

SUMMARY OF THE INVENTION

In order to solve the above and other problems, according to one aspect of the invention, a system for tracking a total output amount of image-carrying medium in various sizes, includes a converter for converting an output amount of the image-carrying medium to a number of sheets in a predetermined standard size; a counter connected to the converter for keeping track of the total output amount in the number of the sheets in the predetermined standard size; and a comparison unit connected to the counter for comparing the total output amount with a predetermined capacity amount and generating a full capacity signal when the total output amount reaching the predetermined capacity.

According to a second aspect of the current invention, a space-saving output catch unit for holding an image-carrying medium, includes an output holder for holding one edge of the image-carrying medium and leaving the other end free so as to substantially save a space occupied by the output holder, the output holder holding up to a predetermined number of sheets of the image-carrying medium of a known size; an output path connected to the output holder for leading the image-carrying medium towards the output holder; and a counter located near the output holder for counting a number of the sheets of the image-carrying medium held in the output holder, the counter generating an interrupt signal for indicating that the number of the sheets of the image-carrying medium in the output holder has reached the predetermined number.

According to a third aspect of the current invention, a system for outputting an image-carrying medium, includes an output holder for holding a predetermined number of sheets of image-carrying medium; an output path connected to the output holder for leading the image-carrying medium to the output holder; a counter located near the output holder for counting a number of the sheets of the image-carrying medium held in the output holder, the counter generating an interrupt signal that indicates that the number of the sheets of the image-carrying medium in the output holder has reached the predetermined number; and a path switch located in the output path for interrupting the output path in response to the interrupt signal so as to prevent an additional sheet beyond the predetermined number from reaching the output holder.

According to a fourth aspect of the current invention, an output catch system for avoiding an overflow of image-carrying media, includes an output unit having an output path for generating an image on the image-carrying media based upon output data and placing the image carrying media in the output path; an output holder located at one end of the output path for holding a predetermined amount of the image-carrying media; a counter located near the output holder for keeping track of a total amount of the image-carrying media, the counter generating a full capacity signal when the counter reads a predetermined output capacity; a controller connected to the counter and the output unit for interrupting the generation of the image-carrying medium in response to the full capacity signal and generating a save signal indicative of saving the output data; and an overflow memory connected to the controller and the output unit for saving the output data in response to the save signal.

According to a fifth aspect of the current invention, a turn-over type output catch unit for holding an image-carrying medium, includes a turn-over path unit having a pair of U-shape guide plates for turning the image-carrying medium front to back as the image-carrying medium is guided between the U-shape guide plates towards one end of the turn-over path, one of the U-shaped guide plates having an operable portion for opening a part of the turn-over path defining an open position so as to allow the image-carrying medium at the one end of the turn-over path to extend without conforming to the U-shape guide plates, the operable portion at the open position also interrupting the turn-over path; an output holding unit connected to the one end of the turn-over path for holding a portion of the image-carrying medium; a counter located near the output holding unit for generating a full signal upon reaching a predetermined number of the image-carrying medium held by the output holding unit; and a control unit connected to the turn-over path for opening the operable portion in response to the full signal so as to prevent an additional image-carrying medium from reaching the output holding unit.

According to a sixth aspect of the current invention, a method of tracking a total output amount of image-carrying medium in various sizes, includes the steps of a) converting an output amount of the image-carrying medium to a number of sheets in a predetermined standard size; b) counting the total output amount in the number of the sheets in the predetermined standard size; c) comparing the total output amount with a predetermined capacity amount; and d) generating a full capacity signal when the total output amount reaching the predetermined capacity.

According to a seventh aspect of the current invention, a method of holding an image-carrying medium by an output holder, includes the steps of: a) leading the image-carrying medium towards the output holder along an output path; b) holding one edge of the image-carrying medium and leaving the other end free so as to substantially save a space occupied by the output holder; c) counting a number of the sheets of the image-carrying medium held in the output holder; and d) generating an interrupt signal when the number of the sheets of the image-carrying medium in the output holder has reached a predetermined number.

According to an eighth aspect of the current invention, a method of outputting an image-carrying medium, includes the steps of a) leading the image-carrying medium to an output holder along an output path; b) holding a predetermined number of sheets of image-carrying medium in the output holder; c) counting a number of the sheets of the image-carrying medium held in the output holder; d) generating an interrupt signal that when the number of the sheets of the image-carrying medium in the output holder has reached the predetermined number; and e) interrupting the output path in response to the interrupt signal so as to prevent an additional sheet beyond the predetermined number from reaching the output holder.

According to a ninth aspect of the current invention, a method of avoiding an overflow of image-carrying media, includes the steps of a) generating an image on the image-carrying media based upon output data; b) moving the image carrying media towards an output holder along an output path; c) holding a predetermined amount of the image-carrying media; d) keeping track of a total amount of the image-carrying media; e) generating a full capacity signal when the total among of the image-carrying media is equal to a predetermined output capacity; f) interrupting the generation of the image-carrying medium in response to the full capacity signal; g) generating a save signal indicative of saving the output data; and h) saving the output data in response to the save signal.

According to a tenth aspect of the current invention, a method of holding an image-carrying medium in a turn-over type output catch unit, including the steps of a) turning the image-carrying medium front to back as the image-carrying medium is guided between a pair of U-shape guide plates towards one end of the U-shape guide plates; b) holding a portion of the image-carrying medium by an output holding unit upon arriving at the one end of the U-shaped guide plates; c) opening an operable part of the U-shape guide plate to an open position for making an open space so as to allow a free portion of the image-carrying medium to extend through the open space without conforming to the U-shape guide plates; d) generating a full signal when a predetermined number of the image-carrying medium is held in step b); and e) leaving the operable part at the open position in response to the full signal so as to prevent an additional image-carrying medium from reaching the output holding unit.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
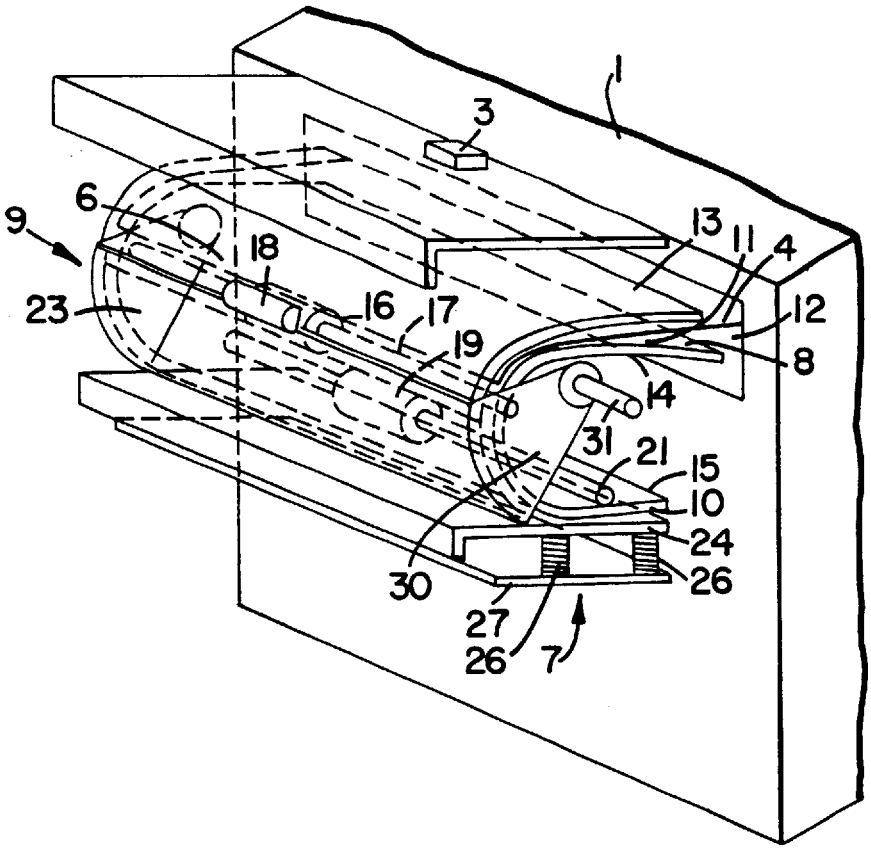
FIG. 1 (PRIOR ART)
FIG. 1 illustrates a perspective view of a prior art output catch tray unit.
Figure 2:
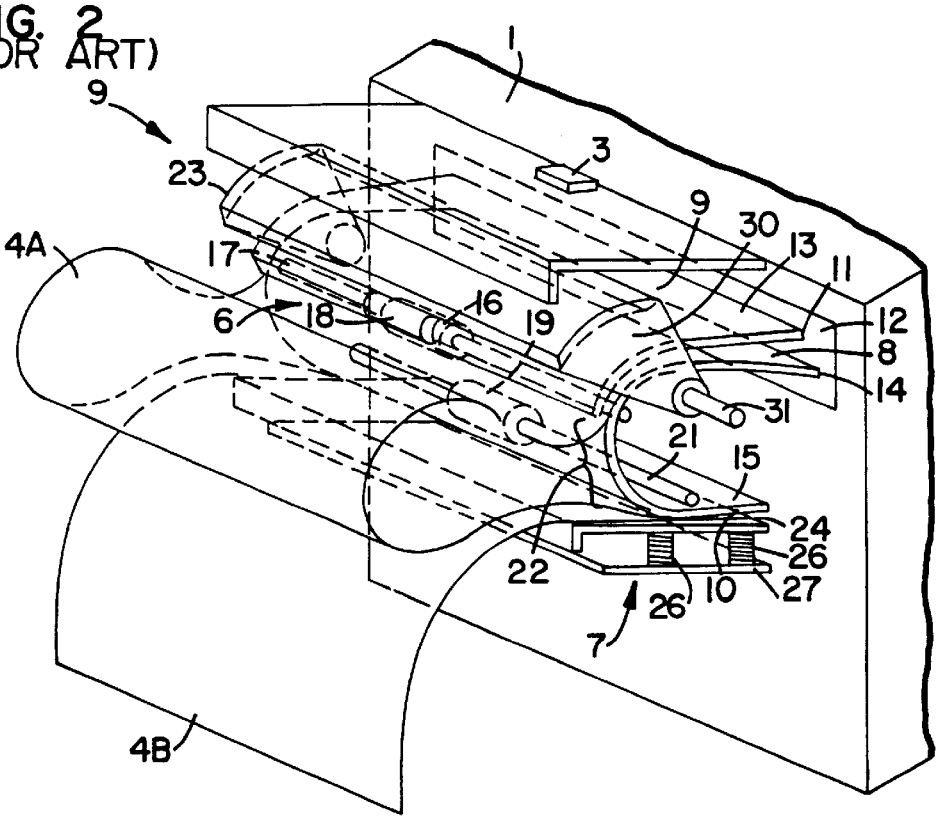
FIG. 2 (PRIOR ART)
FIG. 2 illustrates a perspective view of the prior art catch tray unit of FIG. 1 when an operable portion of an outer path guide plate is placed in an open position.
Figure 3:
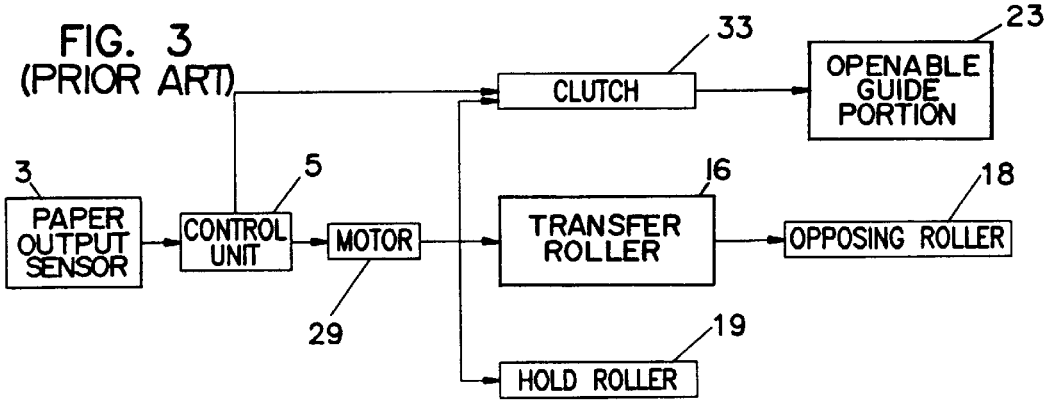
FIG. 3 (PRIOR ART)
FIG. 3 is a block diagram of certain components of the prior art catch tray unit of FIG. 1.
Figure 4:
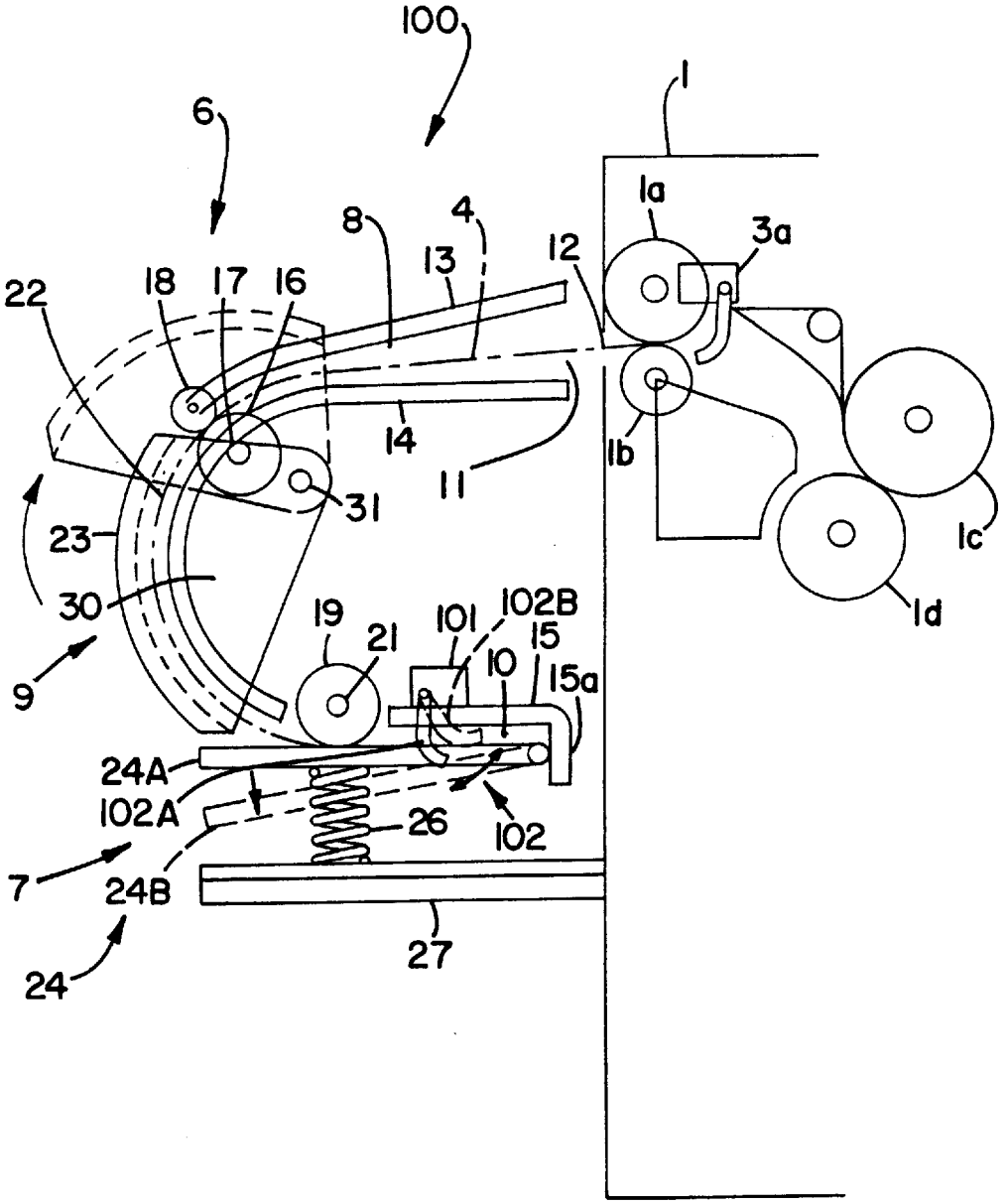
FIG. 4 illustrates a cross sectional view of certain components of a preferred embodiment of an output catch tray unit according to the current invention.

Referring now to the drawings, wherein like reference numerals designate corresponding structure throughout the views, and referring in particular to FIG. 4, according to one preferred embodiment of the current invention, an image-carrying medium 4 is outputted through an output outlet 12 by a pair of output rollers 1*a* and 1*b*. As the image-carrying medium 4 is outputted, a detecting sensor 3*a* senses the image carrying medium 4 and generates an output unit activation signal. In response to the activation signal, a pair of transfer rollers 16 and 18 are activated to rotate at a predetermined speed before the image-carrying medium 4 travels between output path guide plates 13 and 14 to reach the transfer rollers 16 and 18. The image carrying medium 4 further travels toward a holding unit or an output holder 7 between the path guide plates 13 and 14. The outer guide plate 13 includes an operable portion 23. The operable portion 23 has a side plate 30 and pivots at a shaft 31 in a counter clockwise direction as indicated by an arrow. The above described rollers and path guide plates in general are considered as a transferring unit.

Still referring to FIG. 4, the holding unit 7 includes a stacking plate 24, a holding roller 19, a holding plate 15 and a stacking sensor 101. The stacking plate 24 is pivoted at one end opposing a side wall extension of the holding plate 15. A spring 26 is located between the stacking plate 24 and a shelf plate 27 and urges the stacking plate 24 upwardly towards the holding roller 19. As a leading edge of an image-carrying medium reaches the holding roller 19, the image-carrying medium is pushed in between the holding roller 19 and the stacking plate 24 by the rotation of the holding roller 19 towards the side wall 15*a*. The stacking sensor or a counter 101 has a sensor arm 102, and the image-carrying medium 4 pushes the sensor arm from 102*a* to 102*b* in a counter clockwise direction to close a switch to generate a stacking-on signal in the stacking sensor 101. As will be described, the stacking-on signal is used to increment a count in a counter for keeping track of a number of sheets held in the holding unit 7. On the other hand, a stacking-off signal indicates that no sheet of an image carrying medium is held in the holding unit 7. The counter 101 is capable of generating an interrupt signal indicative of a full capacity in the holding unit 7. At the same time, the sacking plate 24 is pushed downwardly about the pivot from 24*a* to 24*b* and further compresses the spring 26 as a pile of the image-carrying medium is stacked between the hold roller 19 and the stacking plate 24.

Figure 5:
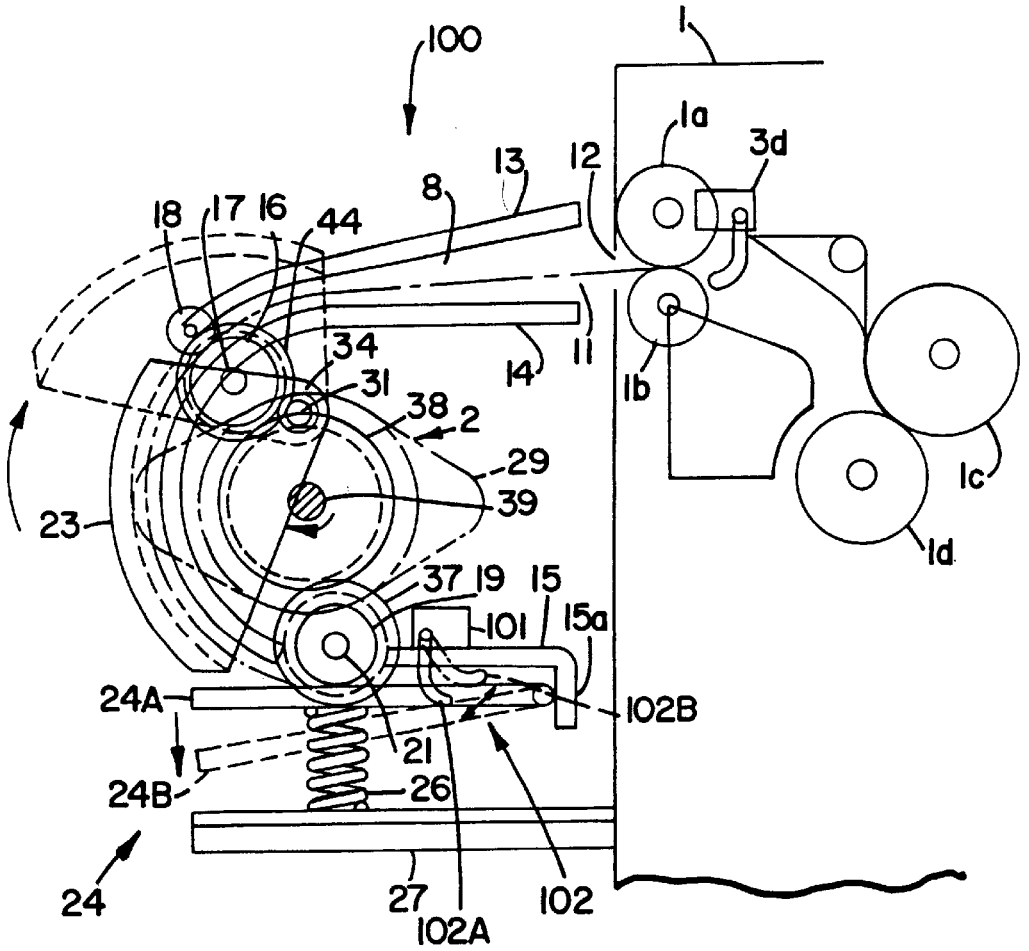
FIG. 5 illustrates a cross sectional view of certain additional components of a preferred embodiment of an output catch tray unit according to the current invention.

Now referring to FIG. 5, according to one preferred embodiment of the current invention, a selective activation mechanism for driving the transfer rollers 16 and 18, the holding roller 19 and the operable portion 23. A motor 29 rotates a first gear 38 in a counter clockwise direction as indicated by an arrow via a shaft 39. A first gear 38 driven by the motor shaft 39 engages a second gear 44 of the transfer roller 16 as well as a third gear 37 of the hold roller 19. According to another preferred embodiment of the current invention, the hold roller 19 additionally includes a torque limiter and one-way clutch. The torque limiter does not allow the hold roller 19 to rotate when the torque on the hold roller 19 is beyond a predetermined torque value. The one-way clutch selectively applies the driving force to the third gear 44 so that the hold roller 19 rotates only in one direction. The operable portion 23 has a fourth gear 34, which selectively engages the third gear 44. The fourth gear 44 is selectively engaged by a clutch to open the operable portion 23. When the fourth gear 44 is disengaged by the clutch, the operable portion 23 returns to its closed position by its own weight. The above described clutches may be either mechanical or electromagnetic.

Figure 6:
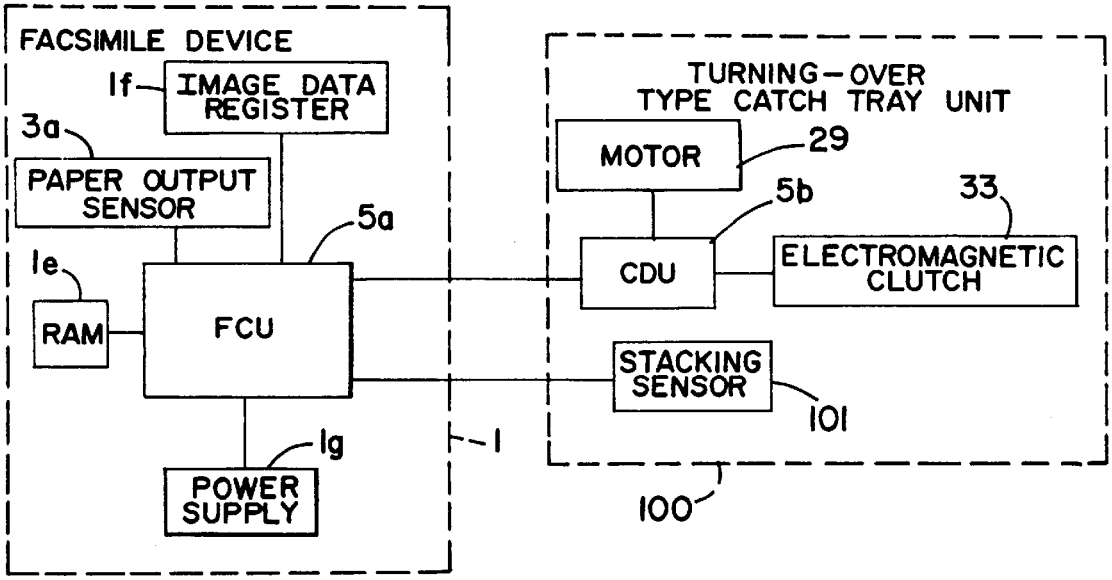
FIG. 6 is a block diagram illustrating operational connections between a facsimile unit and a catch tray unit.

Referring to FIG. 6, a block diagram describes connections among certain components of a turning-over type catch tray unit 100 and an image duplicating device such as a facsimile machine 1 according to one preferred embodiment of the current invention. A facsimile control unit (FCU) generates an image to be outputted on an image-carrying medium based upon image data stored in an image data register 1*f*. As an image-carrying medium is outputted from the image duplicating machine, a paper output sensor 3*a* detects the image-carrying medium and generates an activation signal. Upon receiving the activation signal, the FCU 5*a* sends a corresponding activation signal to another control unit, a catch drive unit (CDU) 5*b*. In response to the corresponding activation signal, the CDU 5*b* activates the motor 29 and an electromagnetic clutch 33 to selectively engage various rollers. According to one preferred embodiment, the CDU 5*b* generates a series of control signals to activate a particular electromagnetic clutch 33 for engaging the corresponding roller. After the image-carrying medium is transferred to a designated holding unit, the image-carrying medium activates a stacking sensor 101. The stacking sensor in turn generates a stacking on signal and sends it to the FCU 5*a*. The FCU 5*a* increments a number of the stacked sheets of the image-carrying medium held in the holding unit. The number is kept in a counter implemented in a random access memory (RAM) 1e connected to the FCU 5*a*. The FCU 5*a* compares the newly incremented count to a predetermined capacity value also stored in RAM 1*e*. Both the FCU 5*a* and the RAM 1e are additionally powered by an internal independent power supply source such as a battery for an unpredictable power failure of a regular power source. According to an alternative embodiment, the counter in the RAM 1*e* is incremented by an activation signal generated by the paper output sensor 3*a*. Furthermore, according to yet another embodiment, the RAM 1*e* includes a conversion table for the use in converting an irregular sized image-carrying medium into a number of sheets in a predetermined standard size.

Referring to FIGS. 7A through 7E, a series of cross sectional views sequentially illustrates how one preferred embodiment of a turning-over type catch tray according to the current invention stacks and holds a pile of image-carrying outputs. In particular, referring to FIG. 7A, an image-carrying medium 4 is being outputted by a pair of output rollers 1*a*, and a paper output sensor 3*a* detects the image-carrying medium 4. The image carrying medium 4 is placed in an output path defined by a pair of U-shape output path guides 13 and 14. An operable portion 23 is a part of the outer path guide 23 and remains closed as a leading portion of the image-carrying medium 4 passes through a portion of the guide path defined by the operable portion 23 and reaches a hold roller 19.

Figure 7A:
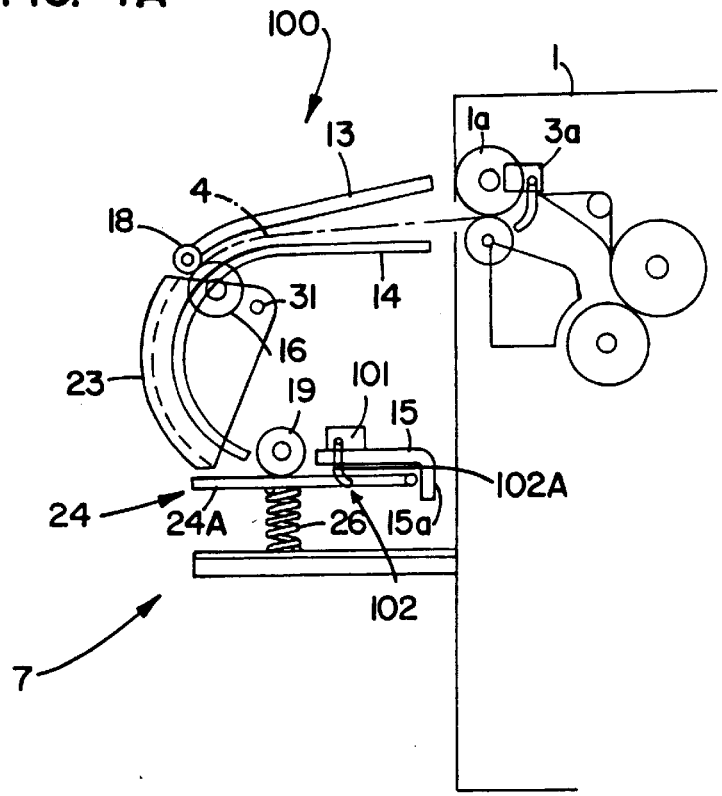
FIG. 7A illustrates a cross sectional view of certain components of one preferred embodiment when an image-carrying medium is approaching to the holding unit.
Figure 7B:
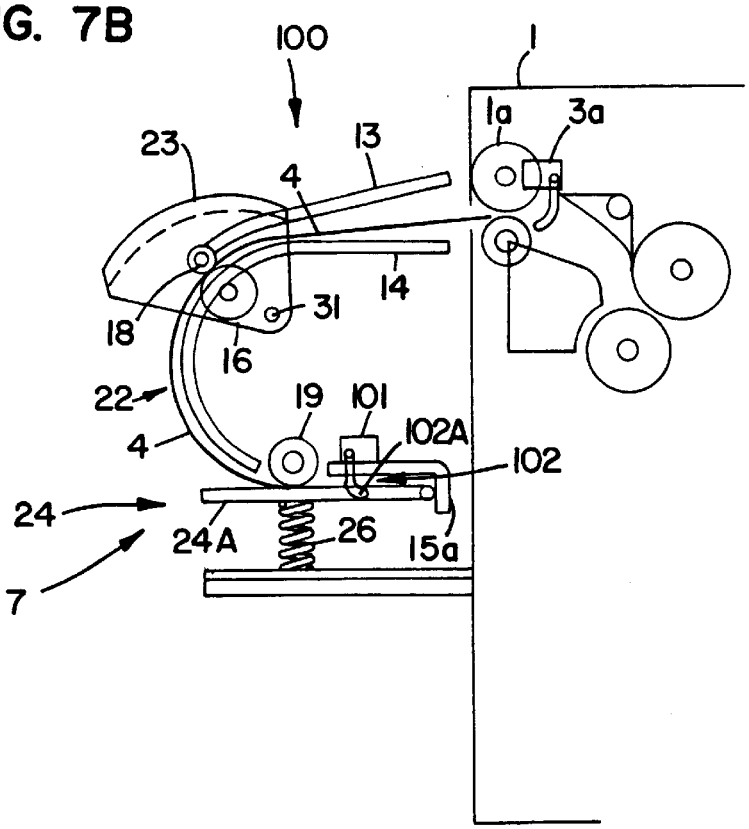
FIG. 7B illustrates a cross sectional view of one preferred embodiment when a leading edge of an image-carrying medium has reached the holding unit and an operable portion of a path guide is opened.

Now referring to FIG. 7B, after the leading portion of the image-carrying medium 4 reaches the holding roller and while that portion is moving towards the holding side plate 15*a*, the operable portion 23 is lifted to expose a trailing portion of the image-carrying medium 4. The leading potion of the image-carrying medium 4 activates the stacking sensor 101 by placing an actuator switch arm 102 at a 102*b* position during its travel towards the side plate 15*a*. The stacking sensor 101 generates a stacking-on signal for indicating that a sheet of the image-carrying medium 4 has arrived to the holding unit 7. This signal is also used to increment a count of the number of sheets held in the holding unit 7. The lift operation is accomplished by engaging an electromagnetic clutch so that a shaft 31 is driven by a motor. At the completion of placing the operable portion 23 at an open position, some portion of the image-carrying medium has not yet passed through transfer rollers 16 and 18 and remain between the transfer rollers 16 and 18 and the output rollers 1*a*.

Figure 7C:
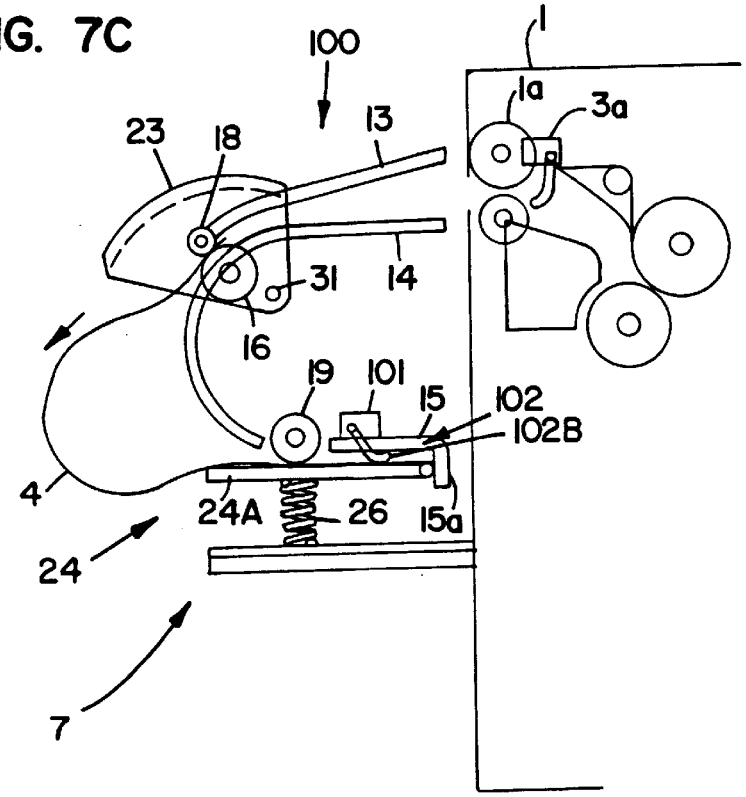
FIG. 7C illustrates a cross sectional view of one preferred embodiment when a trailing portion of an image-carrying medium is rolled out through an opening created by the operable portion at the open position.

Now referring to FIG. 7C, a leading edge of the image carrying medium has reached the holding side wall 15*a*, and the trailing portion of the image-carrying medium 4 is being transferred by the transfer rollers 16 and 18. As the trailing portion is forwarded by the transfer rollers 16 and 18, due to the lack of an outer path guide plate, the trailing portion is pushed outwardly and lateral to the catch tray unit 100. On the other hand, the leading portion of the image-carrying medium is held between a hold roller 19 and a stacking plate 24, which is urged upwardly by a spring 26 towards the hold roller 19. In addition, the holding plate 15 and a corresponding part of the stacking plate 24 hold the leading portion near the leading edge.

Figure 7D:
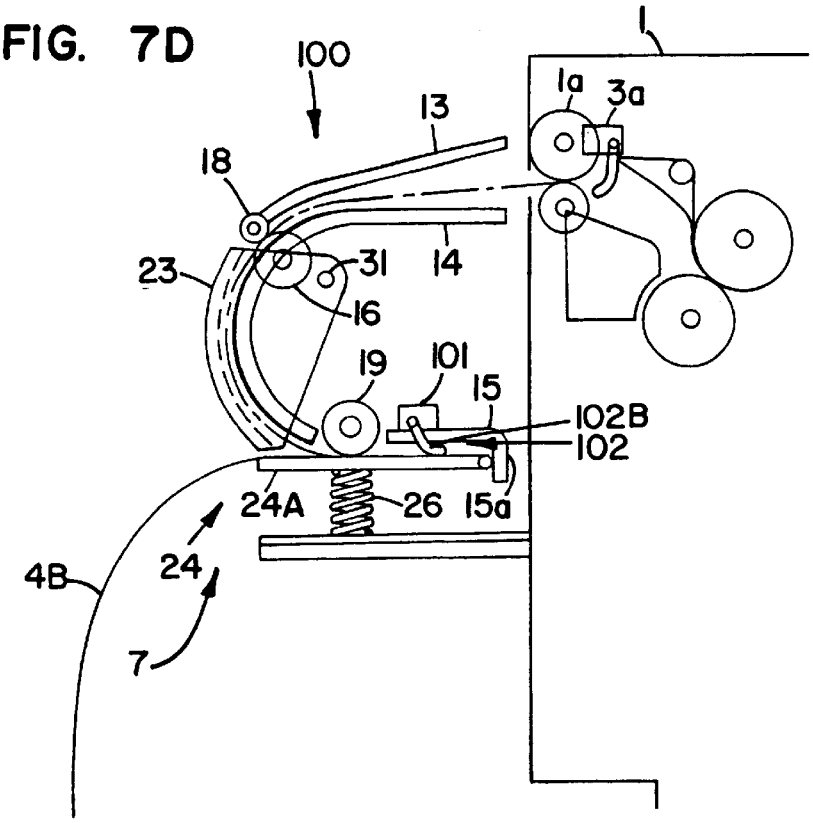
FIG. 7D illustrates a cross sectional view of one preferred embodiment when the trailing portion of the image-carrying medium extends beyond a distal edge of a stacking plate after the operable portion has returned to the original closed potion for restoring the output path leading to the holding unit.

Referring to FIG. 7D, after the trailing edge of the image-carrying medium passes through the transfer rollers 16 and 18, the operable portion 23 is placed back to its original closed position. As a result, only a small portion of the image carrying medium 4 is held by the holding unit 7 while a substantial portion of the image-carrying medium 4 extends beyond a distal end of the stacking plate 24. Because of the weight of the image-carrying medium 4, the image-carrying medium 4 bends downwardly along the distal edge of the stacking plate 24. Furthermore, the U-shaped guide path plates 13 and 14 turn the image-carrying medium 4 front to back during the travel to the holding unit 7. In other words, if the image is on one side of the image-carrying medium, the image side is facing downwardly or on the back as the image-carrying medium enters into the path guide, the image side facing upwardly or the front when the image-carrying medium reaches the holding unit via the U-shaped path guide plates. According to an alternative embodiment, the U-shaped path guide plates are substantially eliminated and the holding unit holds the image-carrying medium in the original front-back position.

In general, the catch tray unit saves space otherwise occupied by the image-carrying medium that is flatly laid in a convectional tray unit. In addition, the holding unit ascertains the outputted sequence of the image-carrying medium. The above described operations as illustrated in FIGS. 7A through 7D are repeated so that a pile of the image carrying medium is neatly stacked at the holding unit 7. However, these operations are altered when a predetermined capacity of the holding unit 7 is reached.

Figure 7E:
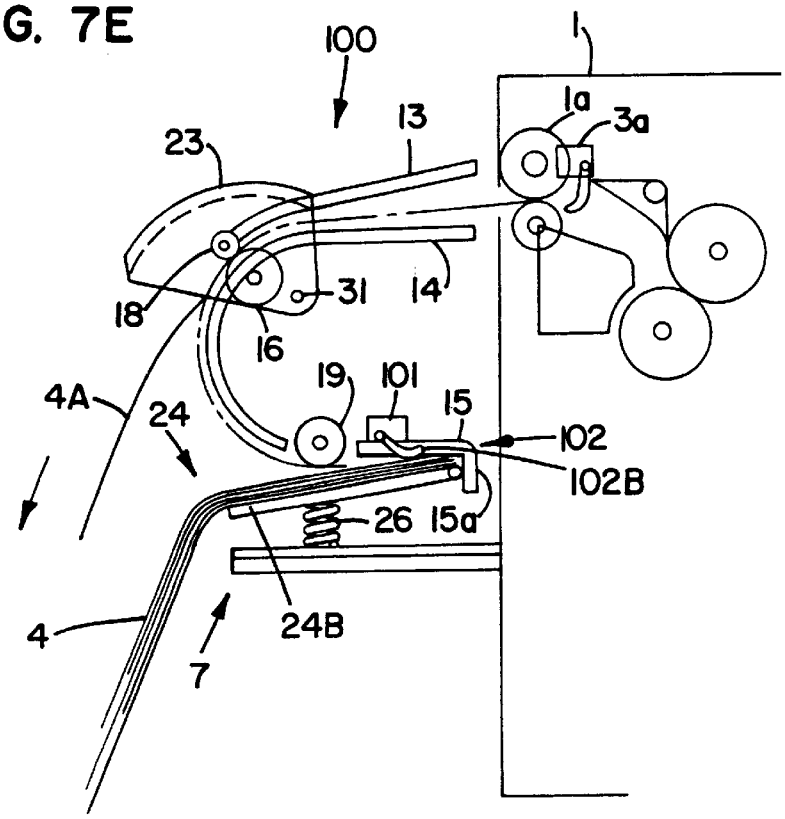
FIG. 7E illustrates a cross sectional view of one preferred embodiment when a holding unit holds a predetermined capacity of the image-carrying medium and the operable portion of the path guide is positioned at the open position so that an incoming image-carrying medium is prevented from reaching the holding unit.

FIG. 7E illustrates a cross sectional view of one preferred embodiment that prevents an incoming image-carrying medium 4A from reaching the holding unit 7, which already holds its predetermined capacity of the stacked image-carrying medium 4B. The operable portion 23 is positioned at its open position before a leading edge of the incoming image-carrying medium 4A reaches the transfer rollers 16 and 18. When the incoming image-carrying medium 4A reaches the exposed path guide area, a leading portion of the incoming image-carrying medium 4A is directed away from the holding unit 7. The incoming image-carrying medium 4A fails to reach the holding unit 7 and generally ends up in a separate tray or on the floor. The operable portion 23 remains at the open position until the piled image-carrying medium 4B is removed from the holding unit 7. Thus, as described above, the openable portion 23 serves as a path switch.

Still referring to FIG. 7E, a stack or a pile of the outputs in the holding unit 7 includes various sizes of the image-carrying medium 4B, and the image-carrying medium 4B does have to be of the identical size in the same pile. In this regard, the maximum holding capacity of the holding unit 7 is determined primarily by a spring 26, but the capacity in terms of a number of sheets of the image-carrying medium depends upon the size of the image-carrying medium 4 as well as the quality of the image-carrying medium in terms of the weight and frictional coefficient. In order to correctly adjust the maximum capacity in terms of the number of sheets of the image-carrying medium, the holding unit has to keep track of certain information for the already stacked image-carrying medium.

Now referring to FIG. 8, the above mentioned adjustable counting process will be described in the following steps as summarized in a flow chart. In a step 900, time variables T1 and T2 are respectively set to default values of predetermined time t1 and t3, which are determined by respectively measuring an amount of time for a leading edge of an image carrying medium to reach a holding unit and for the image-carrying medium to be placed in a final holding position. When an image-carrying medium such as paper is outputted, in a step 901, the output is detected. Upon the detection, a motor is started in a step 902. After the detection in the step 901, if a predetermined amount of time t1 has elapsed, a clutch is turned on in a step 904. During the predetermined amount of time t1, the image-carrying medium is transferred along the guided path through an operable portion. At the end of the predetermined amount of time t1, the activated clutch allows the motor to open the operable portion.

In a step 905, it is determined whether a stacking-on signal has been received. The stacking-on signal indicates that the image-carrying medium has indeed reached the holding unit and has activated a stacking sensor. If no stacking-on signal is generated, the time variable T1 is reset to the default value t1 in a step 906. In addition, an output sheet counter is also reset in the step 906. These resetting operations are performed since the last image carrying medium is assumed not to have reached the holding unit and that no image-carrying medium is being held in the holding unit. On the other hand, if the stacking-on signal is received, it is assumed that the image carrying medium has reached the holding unit and that at least one sheet of an image-carrying medium is currently held in the holding unit. Time elapsed after the output detection in the step 901 is compared against another predetermined amount of time t3 in a step 907. If t3 has elapsed, it is presumed that the image-carrying medium has reached the final holding position and the motor is deactivated in a step 908. When the motor stops, the operable portion automatically closes to the initial closed position.

In a step 909, it is determined whether the size of the last outputted image-carrying medium is larger than a predetermined standard size. In order to output a large size sheet, since a roll paper is used according to one preferred method, the step 909 makes the above described decision initially based upon the use or non-use of the roll paper. In a further step 910, the size of the last outputted image-carrying medium is determined in terms of a number of pages or sheets in a predetermined size in a step 911. The above described conversion process will be fully described with respect to FIG. 9. If, on the other hand, either step 909 or 910 determines that no roll paper is used or that the size is not larger than the standard, the last outputted image-carrying medium is counted as one standard-size page in a step 912. After the number of standard size pages for the last outputted image-carrying medium has been determined, the counter is incremented by the determined number of pages respectively in either step 911 or 912. In a step 913, the newly incremented count of pages is compared to a predetermined capacity of a holding unit of a catch tray unit in a step 913. In this exemplary step, the capacity is set to 50 pages in the predetermined standard size. If the newly incremented count is below the predetermined capacity, the process returns to the step 901. On the other hand, if the predetermined capacity has been reached, the predetermined amount of the time variable T1 is changed to t2, which is shorter than t1. The shorter time t2 makes the operable portion to be placed at an open position before the leading edge reaches the holding unit. In effect, the image-carrying medium bypasses the holding unit and is prevented from reaching the holding unit.

Figures 9, 10:
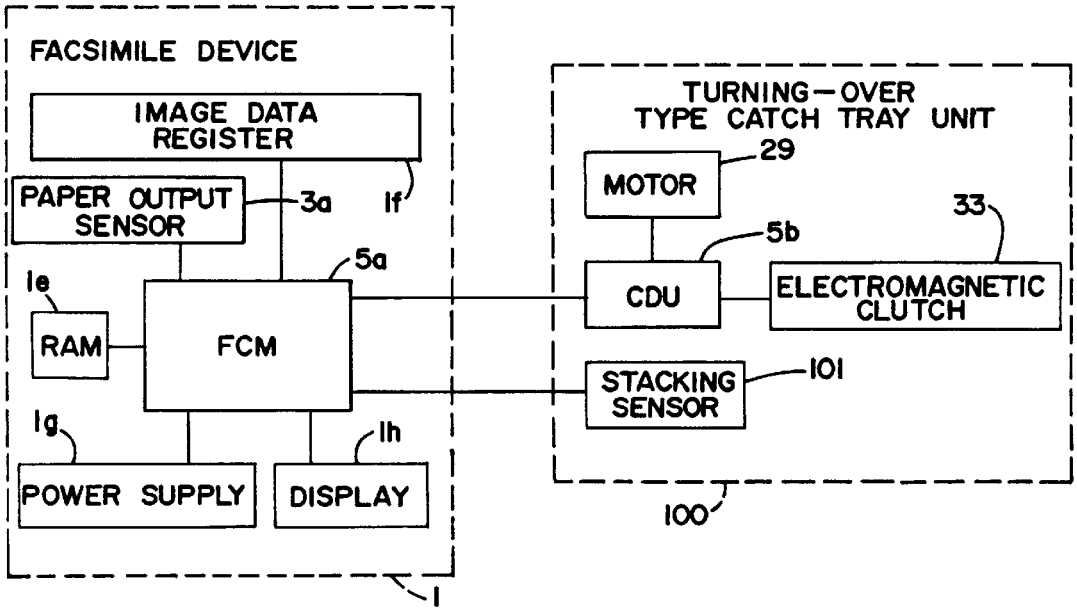
FIG. 9 is a conversion table for converting various sizes of image-carrying media into a number of sheets in a standard size.
FIG. 10 is a block diagram illustrating connections among components in a preferred embodiment of an output catch tray unit in relation to an exemplary duplicating machine.

Now referring to FIG. 9, a conversion table or a converter is used for determining a number of sheets in a predetermined standard size for a non-standard image-carrying medium. According to one preferred embodiment of the current invention, the conversion table is implemented as data in a random access memory (RAM) and a control unit such as FCU as shown in FIG. 6. One example of such a conversion table includes the length of an image carrying medium and its corresponding numbers or counts in a predetermined standard size. According to this example, B4 size which is less than 364 mm length is used as a standard size, and the paper length ranging between 500 mm and 800 is considered as two standard pages. Another example of the conversion table is constructed based upon the weight of a sheet of each image-carrying medium. Because the conversion step is a simple look up step, as the holding capacity of the catch tray unit changes, the conversion step is easily adjusted by modifying the conversion table data.

Referring to FIG. 10, an alternative embodiment of the current invention is described in a block diagram. Since FIG. 10 is substantially similar to FIG. 6, the following description will be given only to components that are modified. In the alternative embodiment, when a catch tray holds a predetermined maximal amount of the image-carrying medium, a warning message is displayed in a display 1*h*. The warning message may be alpha-numeric characters, flashing lights, or any audio signal so that an operator is notified of the above described overflow situation and is advised of removing the stack from the holding unit. According to a second alternative embodiment, while the above described warning message is displayed, the overflow image-carrying data is temporarily stored in a memory device such as the battery backed RAM 1*e* before it is outputted on an image-carrying medium. The stored information is later outputted on an image-carrying medium after the overflow situation is rectified by removing a pile of sheets from a holding unit. To maintain the integrity of the image-carrying data, the stored device such as the RAM 1*e* is backed by an additional power supply source such as a battery 1*g*.

Figure 8:
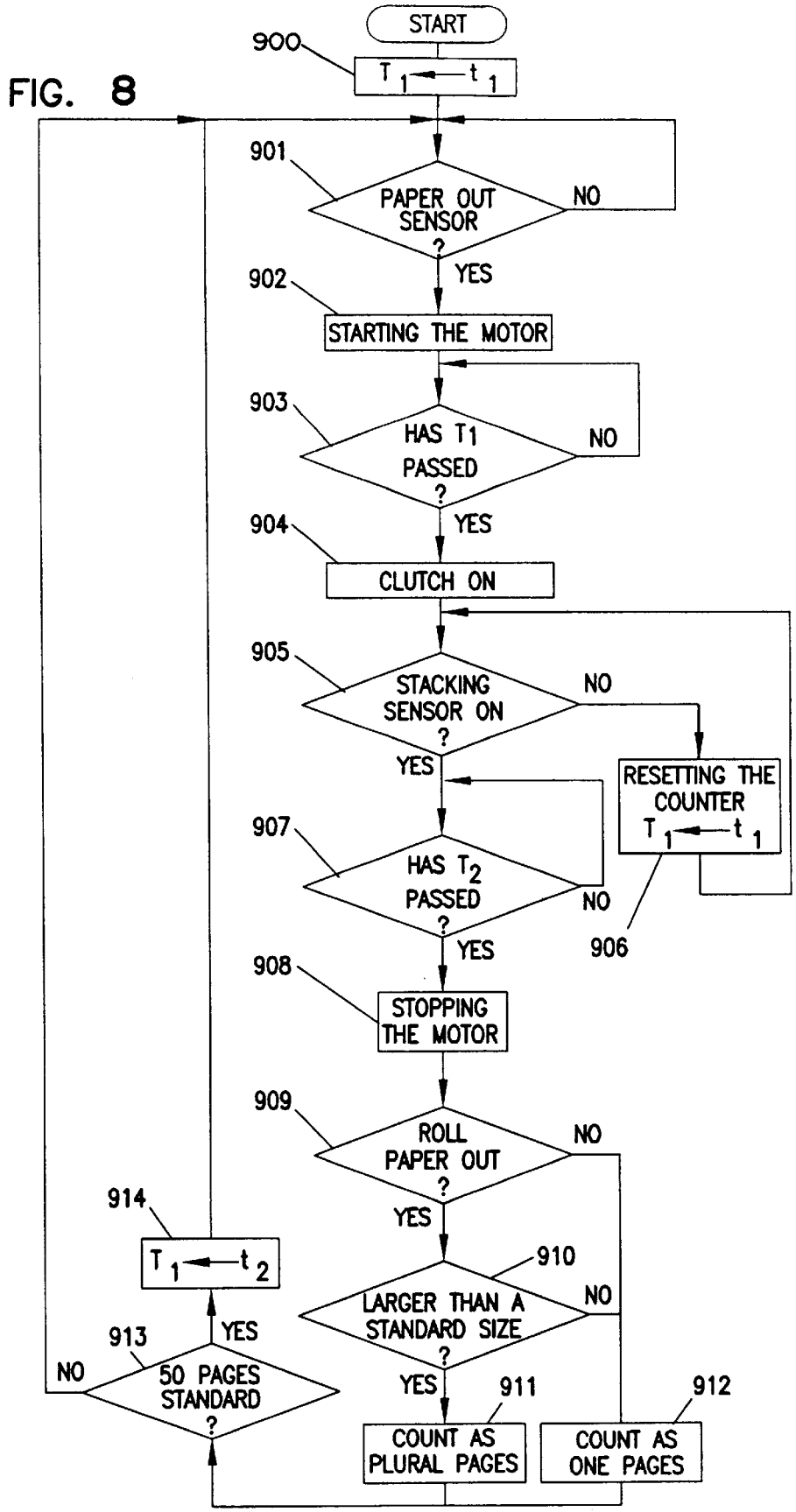
FIG. 8 is a flow chart describing steps involved in a process of controlling an output path for preventing an incoming image-carrying medium from stacking in a holding unit beyond its predetermined capacity.
Figure 11:
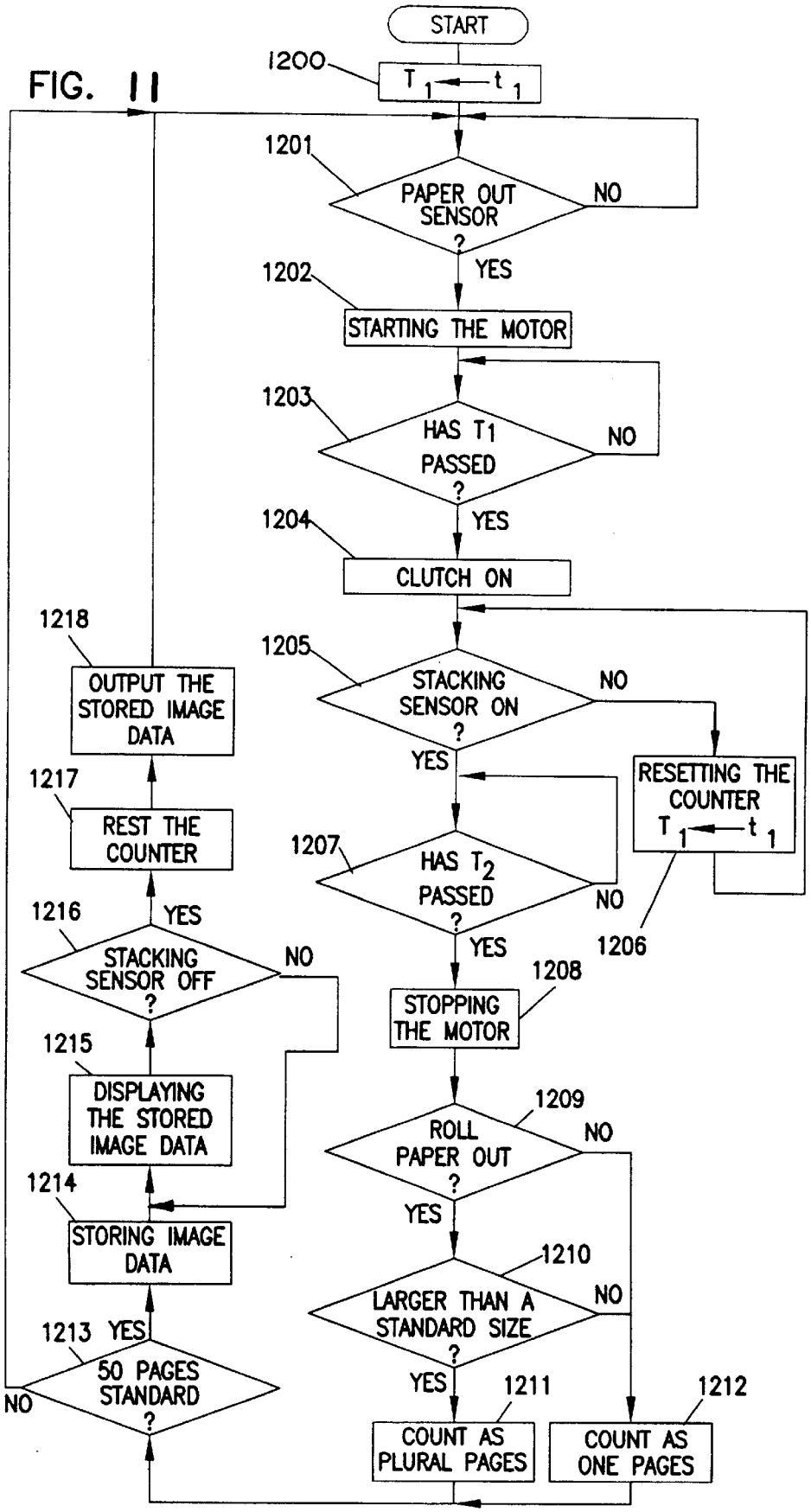
FIG. 11 is a flow chart describing steps involved in an alternative process of controlling an output path for preventing an incoming image-carrying medium from stacking in a holding unit beyond its predetermined capacity as well as displaying a warning message.

Referring to FIG. 11, the operations of the above described alternative embodiment is illustrated in a flow chart which includes similar steps of FIG. 8. The descriptions of the steps 1200 through 1213 are identical to those of steps 900 through 913 of FIG. 8 and are not repeated here. Steps unique to the operation of the alternative embodiment includes steps 1214 through 1218. In stead of overflowing or bypassing sheets of the image-carrying medium, a step 1214 stores the overflow image information in a temporary storage. In a step 1215, some information regarding the stored image data is displayed to an operator via a display such as a facsimile operation display. The information includes a number of stored pages in a predetermined standard size. In a step 1216, a stacking sensor is checked to see if the maximum capacity pile has been completely removed. If indeed removed, in a step 1217, the counter is reset to zero, and in a subsequent step 1218, the stored data is outputted. On the other hand, if the maximum pile is not removed, the display is repeated until the pile is removed.

It is to be understood, however, that even though numerous characteristics and advantages of the present invention have been set forth in the foregoing description, together with details of the structure and function of the invention, the disclosure is illustrative only, and changes may be made in detail, especially in matters of software, hardware and arrangement of software/hardware parts. For example, according to an alternative embodiment of the current invention, either or both the paper output sensor 3 or the stacking-on sensor are implemented by an optical sensor. These changes are made within the principles of the invention to the full extent indicated by the broad general meaning of the terms in which the appended claims are expressed.

What is claimed is:

1. A system for tracking a total output amount of image-carrying medium in various sizes, comprising:

an output holder having a predetermined capacity equivalent in a predetermined standard size for holding the image-carrying medium of various sizes;

a converter for converting an output amount of the image-carrying medium to a number of sheets in the predetermined standard size;

a counter connected to said converter for keeping track of the total output amount in the number of the sheets in the predetermined standard size; and a comparison unit connected to said counter for comparing the total output amount with the predetermined capacity of said output holder and generating a full capacity signal when the total output amount reaching the predetermined capacity.

2. The system for tracking a total output amount of image-carrying medium according to claim 1 wherein said converter converts the output amount of the image-carrying medium based upon the size of the image-carrying medium.

3. The system for tracking a total output amount of image-carrying medium according to claim 1 wherein said converter converts the output amount of the image-carrying medium based upon the weight of the image-carrying medium.

4. The system for tracking a total output amount of image-carrying medium according to claim 1 wherein said output holder holds one end of the image-carrying medium.

5. The system for tracking a total output amount of image-carrying medium according to claim 4 further comprising an output transfer unit connected to said comparison unit for selectively transferring the image-carrying medium to said output holder, said output transferring unit preventing the image-carrying medium from reaching said output holder in response to the full capacity signal.

6. The system for tracking a total output amount of image-carrying medium according to claim 5 wherein said output transfer unit includes a turn-over path for guiding the image-carrying medium towards said output holder while the image-carrying medium is turned front to back.

7. The system for tracking a total output amount of image-carrying medium according to claim 6 wherein said turnover path has an operable portion for allowing the image-carrying medium located at said output holder to extend without conforming to the shape of said turn-over path.

8. The system for tracking a total output amount of image-carrying medium according to claim 1 further comprising a memory unit connected to said comparison unit for saving image data to be outputted on the image-carrying medium in response to the full capacity signal.

9. The system for tracking a total output amount of image-carrying medium according to claim 1 further comprising a display unit connected to said comparison unit for displaying a user warning message in response to the full capacity signal.

10. The system for tracking a total output amount of image-carrying medium according to claim 1 wherein said converter includes a conversion table for converting the output amount of the image-carrying medium to the number of sheets in the predetermined standard size.

11. A space-saving output catch unit for holding an image-carrying medium, comprising:

an output holder for holding one edge of the image-carrying medium and leaving the other end free so as to substantially save a space occupied by said output holder, said output holder holding up to a predetermined number of sheets of the image-carrying medium of a known size;

an output path connected to said output holder for leading the image-carrying medium towards said output holder; and a counter located near said output holder for counting a number of the sheets of the image-carrying medium held in said output holder, said counter generating an interrupt signal for indicating that the number of the sheets of the image-carrying medium in said output holder has reached said predetermined number.

12. The space-saving output catch unit according to claim 11 further comprising a path switch located in said output path for interrupting said output path in response to the interrupt signal so as to selectively prevent the image-carrying medium from reaching said output holder.

13. The space-saving output catch unit according to claim 11 further comprising a memory unit connected to said counter for saving image data to be outputted on the image-carrying medium in response to the interrupt signal.

14. The space-saving output catch unit according to claim 11 wherein said output path includes a pair of U-shaped guide plates for guiding the image-carrying medium between said two guide plates.

15. The space-saving output catch unit according to claim 14 wherein one of said guide plates has an operable portion for allowing the other end of the image-carrying medium not held by said output holder to extend outside of said guide plates.

16. The space-saving output catch unit according to claim 11 wherein said counter converts a first number of the sheets of the image-carrying medium in various sizes to a second number of sheets in a predetermined standard size.

17. The space-saving output catch unit according to claim 11 wherein said counter includes a sensor for detecting the image-carrying medium in said output holder.

18. The space-saving output catch unit according to claim 17 wherein said detector resets the number of the sheets of the image-carrying medium held in said output holder to zero upon detecting no image-carrying medium.

19. A system for outputting an image-carrying medium, comprising:

an output holder for holding a predetermined number of sheets of image-carrying medium;

an output path connected to said output holder for leading the image-carrying medium to said output holder;

a counter located near said output holder for counting a number of the sheets of the image-carrying medium held in said output holder, said counter generating an interrupt signal that indicates that the number of the sheets of the image-carrying medium in said output holder has reached said predetermined number; and a path switch located in said output path for interrupting said output path in response to said interrupt signal so as to prevent an additional sheet beyond said predetermined number from reaching said output holder.

20. The system for outputting an image-carrying medium according to claim 19 where said output holder holds one edge of the image-carrying medium and leaving the other end free so as to substantially save a space occupied by said output holder.

21. The system for outputting an image-carrying medium according to claim 19 wherein said counter converts a first number of the sheets of the image-carrying medium in various sizes to a second number of sheets in a predetermined standard size.

22. The system for outputting an image-carrying medium according to claim 19 wherein said counter includes a sensor for detecting the image-carrying medium in said output holder.

23. The system for outputting an image-carrying medium according to claim 19 wherein said path switch is a movable path guide for selectively altering a path for the image-carrying medium.

24. An output catch system for avoiding an overflow of image-carrying media, comprising:

an output unit having an output path for generating an image on the image-carrying media based upon output data and placing the image carrying media in said output path;

an output holder located at one end of said output path for holding a predetermined amount of the image-carrying media;

a counter located near said output holder for keeping track of a total amount of the image-carrying media, said counter generating a full capacity signal when said counter reads a predetermined output capacity;

a controller connected to said counter and said output unit for interrupting the generation of the image-carrying medium in response to the full capacity signal and generating a save signal indicative of saving the output data; and an overflow memory connected to said controller and said output unit for saving the output data in response to the save signal.

25. The output catch system for avoiding an overflow according to claim 24 further comprising a display unit connected to said controller for displaying a user warning message in response to the save signal.

26. The output catch system for avoiding an overflow according to claim 24 wherein said output unit selectively terminates the generation of the image on the image-carrying media.

27. The output catch system for avoiding an overflow according to claim 24 wherein said counter converts a first number of the sheets of the image-carrying medium in various sizes to a second number of sheets in a predetermined standard size for a comparison with the predetermined output capacity.

28. A turn-over type output catch unit for holding an image-carrying medium, comprising:

a turn-over path unit having a pair of U-shape guide plates for turning the image-carrying medium front to back as the image-carrying medium is guided between said U-shape guide plates towards one end of said turn-over path, one of said U-shaped guide plates having an operable portion for opening a part of said turn-over path defining an open position so as to allow the image-carrying medium at said one end of said turn-over path to extend without conforming to said U-shape guide plates, said operable portion at the open position also interrupting the turn-over path;

an output holding unit connected to said one end of said turn-over path for holding a portion of the image-carrying medium;

a counter located near said output holding unit for generating a full signal upon reaching a predetermined number of the image-carrying medium held by said output holding unit; and a control unit connected to said turn-over path for opening said operable portion in response to the full signal so as to prevent an additional image-carrying medium from reaching said output holding unit.

29. A method of tracking a total output amount of image-carrying medium in various sizes, comprising the steps of:

a) holding the image-carrying medium of various sizes up to a predetermined capacity equivalent in a predetermined standard size;

b) converting an output amount of the image-carrying medium to a number of sheets in the predetermined standard size;

c) counting the total output amount in the number of the sheets in the predetermined standard size;

d) comparing the total output amount with the predetermined capacity; and e) generating a full capacity signal when the total output amount reaching the predetermined capacity.

30. The method of tracking a total output amount of image-carrying medium according to claim 29 wherein said step a) converts the output amount of the image-carrying medium based upon the size of the image-carrying medium.

31. The method of tracking a total output amount of image-carrying medium according to claim 29 wherein said step a) converts the output amount of the image-carrying medium based upon the weight of the image-carrying medium.

32. The method of tracking a total output amount of image-carrying medium according to claim 29 further includes another step f) of selectively transferring the image-carrying medium in response to the full capacity signal.

33. The method of tracking a total output amount of image-carrying medium according to claim 32 wherein said step f) guides the image-carrying medium along a path guide towards an output holder while the image-carrying medium is turned front to back.

34. The method of a total output amount of image-carrying medium according to claim 33 wherein said step f) allows the image-carrying medium located at the output holder to extend without conforming to a shape of the path guide.

35. The method of tracking a total output amount of image-carrying medium according to claim 29 further comprising an additional step g) of selectively saving image data to be outputted on the image-carrying medium in response to the full capacity signal.

36. The method of tracking a total output amount of image-carrying medium according to claim 20 further comprising an additional step h) of displaying a user warning message in response to the full capacity signal.

37. The method of tracking a total output amount of image-carrying medium according to claim 29 wherein said step a) converts the output amount of the image-carrying medium to the number of sheets in the predetermined standard size based upon a conversion table.

38. A method of holding an image-carrying medium by an output holder, comprising the steps of:

a) leading the image-carrying medium towards the output holder along an output path;

b) holding one edge of the image-carrying medium and leaving the other end free so as to substantially save a space occupied by the output holder;

c) counting a number of the sheets of the image-carrying medium held in said output holder; and d)generating an interrupt signal when the number of the sheets of the image-carrying medium in the output holder has reached a predetermined number.

39. The method of holding an image-carrying medium according to claim 38 further comprising an additional step e) of interrupting the output path in response to the interrupt signal so as to selectively prevent the image-carrying medium from reaching the output holder.

40. The method of holding an image-carrying medium according to claim 38 further comprising an additional step f) of saving image data to be outputted on the image-carrying medium in response to the interrupt signal.

41. The method of holding an image-carrying medium according to claim 38 wherein said step a) guides the image-carrying medium between a pair of U-shaped guide plates.

42. The method of holding an image-carrying medium according to claim 41 wherein said step a) allows the other end of the image-carrying medium not held by said output holder to extend outside of the guide plates.

43. The method of holding an image-carrying medium according to claim 38 wherein said step c) includes an additional step g) of converting a first number of the sheets of the image-carrying medium in various sizes to a second number of sheets in a predetermined standard size.

44. The method of holding an image-carrying medium according to claim 38 wherein said step c) includes an additional step h) of detecting the image-carrying medium in the output holder.

45. The method of holding an image-carrying medium according to claim 44 wherein said step h) resets the number of the sheets of the image-carrying medium held in the output holder to zero upon detecting no image-carrying medium.

46. A method of outputting an image-carrying medium, comprising the steps of:

a) leading the image-carrying medium to an output holder along an output path;

b) holding a predetermined number of sheets of image-carrying medium in the output holder;

c) counting a number of the sheets of the image-carrying medium held in the output holder;

d) generating an interrupt signal that when the number of the sheets of the image-carrying medium in the output holder has reached the predetermined number; and e) interrupting the output path in response to the interrupt signal so as to prevent an additional sheet beyond the predetermined number from reaching the output holder.

47. The method of outputting an image-carrying medium according to claim 46 where one edge of the image-carrying medium is held and the other end is left free so as to substantially save a space occupied by said output holder in said step b).

48. The method of outputting an image-carrying medium according to claim 46 wherein a first number of the sheets of the image-carrying medium in various sizes converted into a second number of sheets in a predetermined standard size in said step c).

49. The method of outputting an image-carrying medium according to claim 46 wherein said step c) includes an additional step of detecting the image-carrying medium in the output holder.

50. The method of outputting an image-carrying medium according to claim 46 wherein said step e) selectively alters the output path for the image-carrying medium.

51. A method of avoiding an overflow of image-carrying media, comprising the steps of:

a) generating an image on the image-carrying media based upon output data;

b) moving the image carrying media towards an output holder along an output path;

c) holding a predetermined amount of the image-carrying media;

d) keeping track of a total amount of the image-carrying media;

e) generating a full capacity signal when the total among of the image-carrying media is equal to a predetermined output capacity;

f) interrupting the generation of the image-carrying medium in response to the full capacity signal;

g) generating a save signal indicative of saving the output data; and h) saving the output data in response to the save signal.

52. The method of avoiding an overflow according to claim 51 further comprising an additional step h) of displaying a user warning message in response to the save signal.

53. The method of avoiding an overflow according to claim 51 wherein a first number of the sheets of the image-carrying medium in various sizes is converted into a second number of sheets in a predetermined standard size for a comparison with the predetermined output capacity in said step d).

54. A method of holding an image-carrying medium in a turn-over type output catch unit, comprising the steps of:

a) turning the image-carrying medium front to back as the image-carrying medium is guided between a pair of U-shape guide plates towards one end of the U-shape guide plates;

b) holding a portion of the image-carrying medium by an output holding unit upon arriving at the one end of the U-shaped guide plates;

c) opening an operable part of the U-shape guide plate to an open position for making an open space so as to allow a free portion of the image-carrying medium to extend through the open space without conforming to the U-shape guide plates;

d) generating a full signal when a predetermined number of the image-carrying medium is held in step b); and e) leaving the operable part at the open position in response to the full signal so as to prevent an additional image-carrying medium from reaching the output holding unit.

* * * * *